US005297713A

United States Patent [19]

Perra et al.

[11] Patent Number: 5,297,713

[45] Date of Patent: Mar. 29, 1994

[54] REAR LOAD MAGAZINE ASSEMBLY

[75] Inventors: Arthur E. Perra, Hope Valley; Brian M. White, Riverside, both of R.I.; Thomas E. Babington, Seekonk, Mass.

[73] Assignee: Stanley-Bostitch, Inc., East Greenwich, R.I.

[21] Appl. No.: 40,996

[22] Filed: Mar. 31, 1993

[51] Int. Cl.[5] ..... B25C 1/00

[52] U.S. Cl. ..... 227/123; 227/120

[58] Field of Search ..... 227/123, 109, 126, 120, 227/127, 128, 122

[56] References Cited

U.S. PATENT DOCUMENTS

| | | | |
|---|---|---|---|
| 2,733,440 | 2/1956 | Jenny | 227/123 |
| 3,708,096 | 1/1973 | Burke, Jr. | 227/130 |
| 3,840,165 | 10/1974 | Howard | 227/123 X |
| 3,957,192 | 5/1976 | Fehrs | 227/123 |
| 4,039,113 | 8/1977 | Males | 227/130 |
| 4,200,215 | 4/1980 | Novak et al. | 227/123 |
| 4,749,115 | 6/1988 | Fehrs | 227/109 |

*Primary Examiner*—Rinaldi Rada

*Attorney, Agent, or Firm*—Cushman, Darby & Cushman

[57] ABSTRACT

A housing structure including a manually engageable handle for enabling a user to portably operate the device and a nosepiece portion disposed forwardly thereof. Extending rearwardly from the nosepiece portion is a magazine assembly which together with the nosepiece define a drive track therebetween. A fastener driving element is slidably mounted in the drive track. Power operated means for moving the fastener driving element are provided within the drive track moving the fastener driving element through successive operative cycles each including a drive stroke in one direction and a return stroke in an opposite direction. The magazine assembly includes a fastener stick receiving feed track and means for biasing a stick of fasteners in the feed track to move a leading fastener of the stick into the drive track to be driven therefrom during the drive stroke of the fastener driving element into a workpiece. Means are provided for mounting the magazine assembly with respect to the housing structure in an operative position with respect to the nosepiece portion and for movement away from and toward the operative position. The magazine assembly is biased into the operative position which allows the magazine assembly to be moved through a first range of movement wherein resilient movement of the magazine assembly away from the nosepiece portion will take place during an unwanted fastener deformation to allow the deformed fastener to self clear after which the magazine assembly is returned to the operative position.

16 Claims, 3 Drawing Sheets

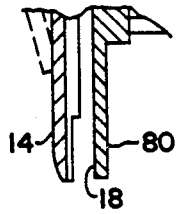
FIG. 8
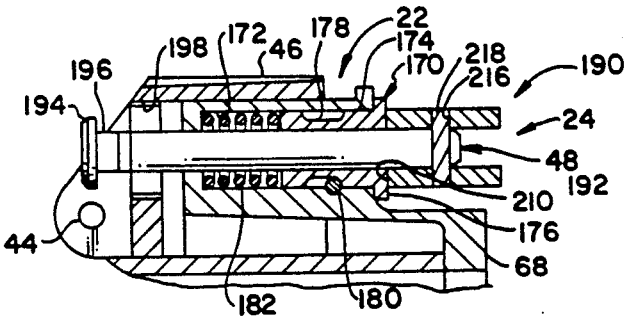
FIG. 7
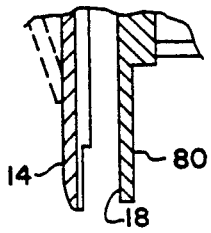
FIG. 10
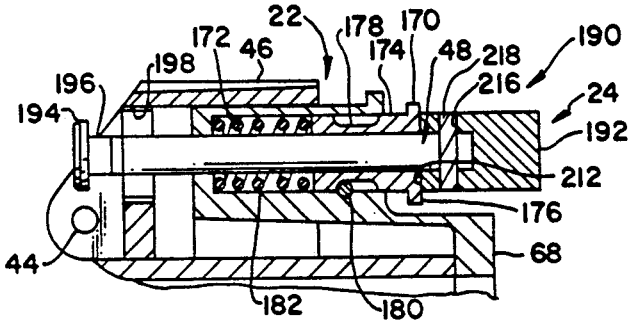
FIG. 9
FIG. 12
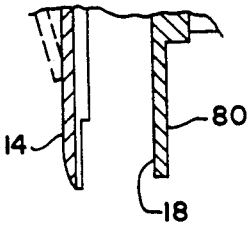
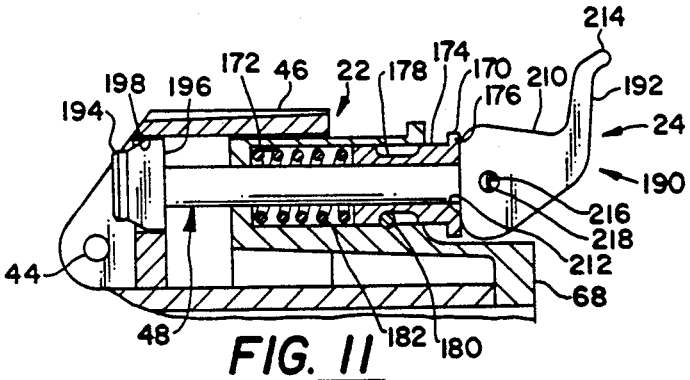
FIG. 11
FIG. 13
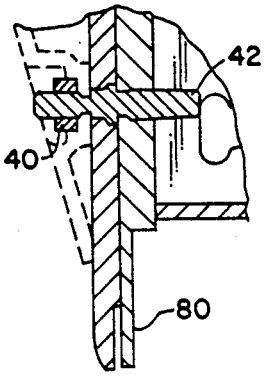
FIG. 14
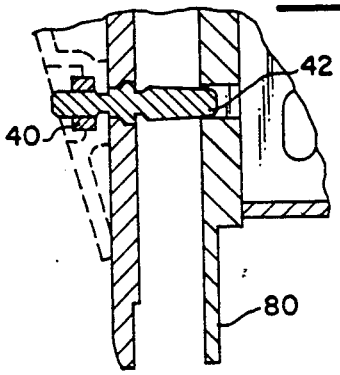

REAR LOAD MAGAZINE ASSEMBLY

BACKGROUND OF THE INVENTION

This invention relates to devices for driving fasteners and more particularly to devices of the type including means for resiliently biasing the magazine assembly towards the nosepiece into an operative position so that resilient movement of the magazine assembly away from the nosepiece will take place during an unwanted fastener deformation so as to allow the deformed fastener to self clear after which the magazine is returned to an operative position.

A common problem with all fastener driving devices is inevitable fastener jams which occur when a fastener is being driven from the device. These jams are the result of a fastener becoming deformed and getting stuck in the drive track. The possible causes of such jamming are well-known, numerous and unpreventable. For example, a knot or hard spot in the workpiece or a defective fastener might be the cause. The problem is particularly acute when long thin fasteners are used which are prone to bending when subjected to the force necessary to drive them into the workpiece. The use of power-driven tools further magnifies the problem because of the large forces generated. Additionally, the drive track components are subjected to undesirable deforming stresses resulting from such jams.

In the conventional tool, it is typically necessary to disassemble the tool in order to allow access to the drive track so that the deformed fastener can be removed. This is both inconvenient and time consuming and results in significant downtime for the tool.

More recently, various arrangements have been devised to facilitate such access. Typical of a first type of arrangement has been a nosepiece which pivots forwardly from the drive track. This pivoting action permits the drive track to be exposed and the deformed fastener to be removed. However, these pivoting nosepieces have proven difficult to open when jamming occurs and equally difficult to close due to the large forces required. Extraneous tools have been required to both open and close the nosepiece. Moreover, the nosepiece is larger when the pivoting mechanism is contained therein which can prevent the device from being moved closer to a workpiece if there is an obstruction in front of the device.

A second type of arrangement is exemplified by U.S. Pat. No. 3,840,165 to Howard. In this arrangement, the magazine opens automatically in response to the deformation of a fastener. This automatic release has the advantage of providing fast and convenient access to the drive track to remove fastener jams. The major difficulty encountered with such a device is that they are prone to frequent and undesired releases of the magazine in response to a fastener deformation. These openings reduce the operator's confidence in the tool and can result in the magazine assembly striking and damaging the workpiece.

SUMMARY OF THE INVENTION

Accordingly, it is an object of this invention to provide a magazine assembly which is biased into an operative position with a nosepiece allowing the magazine assembly to resiliently move away from the nosepiece during an unwanted fastener deformation so as to allow the deformed fastener to self clear after which the magazine assembly is returned to the operative position. In accordance with the principles of the present invention this object is achieved by providing a housing structure including a handle portion defining a manually engageable handle for enabling a user to portably operate the device and a nosepiece portion disposed forwardly thereof. Extending rearwardly from the nosepiece portion is a magazine assembly which together with the nosepiece define a drive track therebetween. A fastener driving element is slidably mounted in the drive track. Power operated means for moving the fastener driving element are provided within the drive track moving the fastener driving element through successive operative cycles each including a drive stroke in one direction and a return stroke in an opposite direction. The magazine assembly includes structure defining a fastener stick receiving feed track and means for biasing a stick of fasteners in the feed track so as to move a leading fastener of the stick into the drive track to be driven therefrom during the drive stroke of the fastener driving element into a workpiece. Means are provided for mounting the magazine assembly with respect to the housing structure in an operative position with respect to the nosepiece portion and for movement away from and toward the operative position. The magazine assembly is resiliently biased into the operative position which allows the magazine assembly to be moved through a first range of movement wherein resilient movement of the magazine assembly away from the nosepiece portion will take place during an unwanted fastener deformation so as to allow the deformed fastener to self clear after which the magazine assembly is returned to the operative position. Means are provided for manual movement of the magazine assembly between (1) a normal operating position wherein the resilient movement within the first range takes place and (2) a release position wherein the magazine assembly is freely movable through a second range of movement beyond the first range enabling a deformed fastener which does not self clear by virtue of the resilient movement within the first range to be cleared.

It is a further object of the invention to provide a device which has a manual quick release latch assembly permitting the magazine assembly to be freely movable rearwardly from the nosepiece in the event of an unwanted fastener deformation beyond the resilient movement that allows access to the drive track so that the deformed fastener can be cleared from the drive track which had not self cleared by virtue of the resilient movement.

Still another object of the present invention is to provide a fastener driving device of the type described which is simple in construction cost effective in operation and requires little maintenance.

These and other objects of the present invention will become more apparent during the course of the following detailed description and appended claims.

The invention may best be understood with reference to the accompanying drawings, wherein an illustrative embodiment is shown.

BRIEF DESCRIPTION OF THE DRAWINGS

FIG. 7 is a partial elevational view of the latch assembly shown with the toggle handle in the operative position and with the magazine assembly having reached the end of the first range of resilient movement;

FIG. 8 is a fragmentary view of the gap between the magazine assembly and the nosepiece portion when the magazine assembly moves rearwardly through a first range of resilient movement;

FIG. 9 is a view similar to FIG. 7 with the toggle handle having been moved to the released position and the magazine assembly having been manually moved to the end of the third range of free movement;

FIG. 10 is view similar to FIG. 8 when the toggle handle is moved to the released position and the magazine assembly is manually moved to the end of the third range of movement;

FIG. 11 is a view similar to FIG. 7 with the toggle handle having been moved to the released position and rotated 90° and the magazine assembly having been manually moved to the end of the fourth range of free movement;

FIG. 12 is a view similar to FIG. 8 when the toggle handle is moved to the released position and the magazine assembly is manually moved to the end of the fourth range of movement;

FIG. 13 is a fragmentary view showing the magazine assembly, the nosepiece portion and the guide pin when in the magazine assembly is in the normal operative position; and FIG. 14 is a fragmentary view showing the magazine assembly, the nosepiece portion and the guide pin at the end of the fourth range of movement.

DETAILED DESCRIPTION OF THE PRESENTLY PREFERRED EXEMPTING EMBODIMENT

Figure 1:
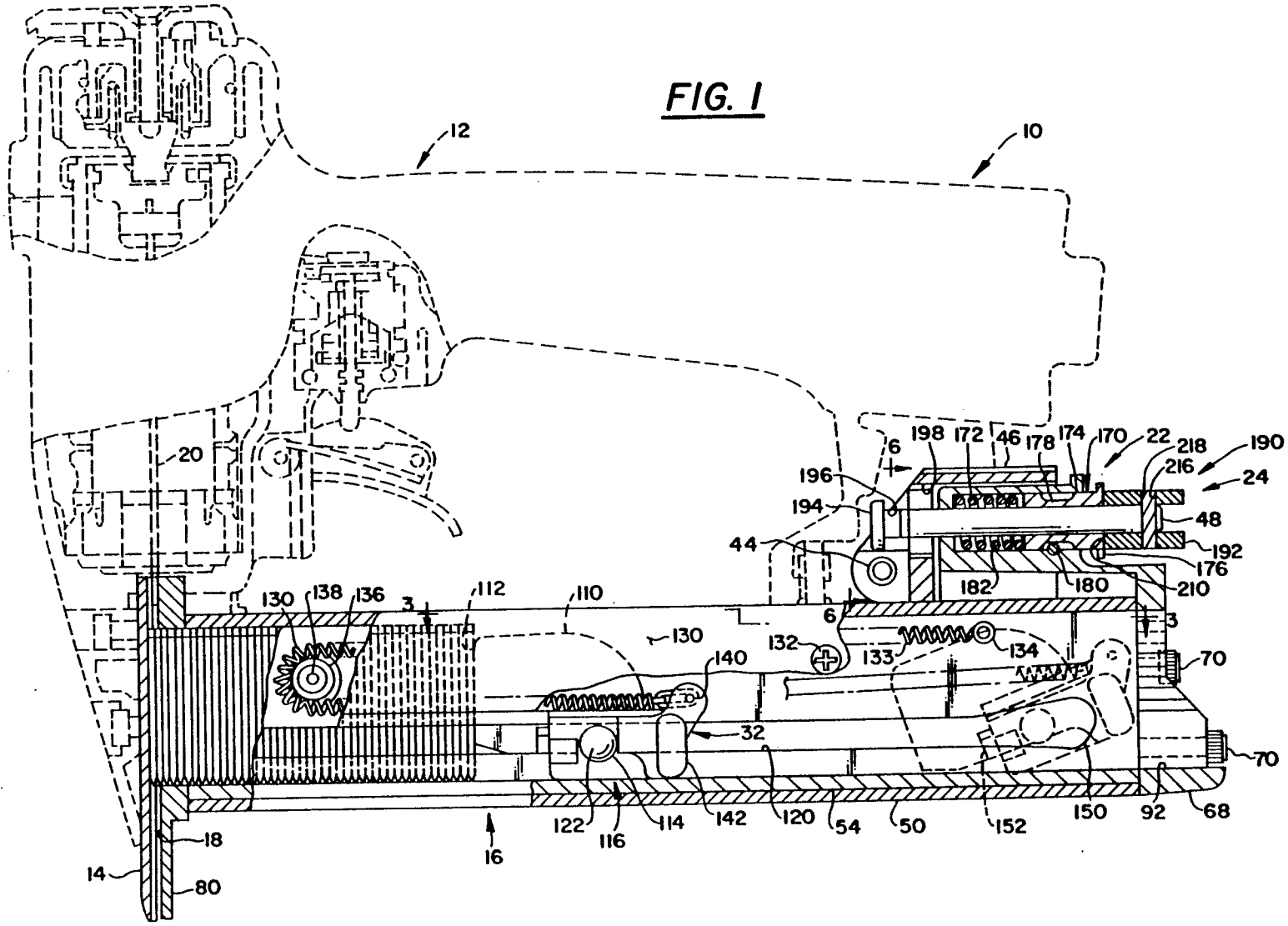
FIG. 1 is a side elevational view of a fastener driving device constructed in accordance with the present invention, shown with the magazine assembly in a normal operative position, with the pusher member shown in solid lines in an operative position and in dotted lines in a rear latched position, with the magazine assembly shown in solid lines for purposes of clearer illustration and the housing structure shown in dotted lines with portions partly broken away.

Referring now more particularly to the drawings, there is shown in FIG. 1 thereof a portable device for driving a fastener from a stick of fasteners, generally indicated at 10, embodying the principles of the present invention. In the drawings, the device is shown oriented so as to drive a fastener vertically downward into a workpiece. It will be understood, however, that the device is capable of driving a fastener into workpieces oriented in any position other than the horizontal. For convenience, the device will be described in relation to the orientation illustrated, and consequently terms such as "horizontal," "vertical," "above," "below," "forward," "rearward," etc. as used herein are to be construed in their relative sense.

The device 10 includes the usual housing structure 12 providing a handle by which an operator is enabled to manually handle the device. The housing structure 12 includes a rigid nosepiece portion 14 located forwardly of the housing structure 12. A magazine assembly 16 extends rearwardly from nosepiece portion 14 and is resiliently biased into the nosepiece portion 14 so as to define therewith an elongated drive track 18 which is adapted to receive laterally therein the leading fastener from a stick of fasteners mounted within the magazine assembly 16. The device 10 includes the usual fastener driving element 20 which is moved within drive track 18 through an operating cycle including a drive stroke and a return stroke preferably by a conventional pneumatic system (shown in dotted lines in FIG. 1). It will be understood that any type of pneumatic system may be utilized, as for example, those shown in U.S. Pat. Nos. 3,708,096 and 4,039,113, the disclosures of which are hereby incorporated by reference in this specification. While pneumatic systems are preferred, other systems, either power or manually operable, for effecting the cycle of operation of the fastener driving element may be utilized as, for example, electrical systems, spring actuated systems, hammer actuated systems, internal combustion actuated systems and the like.

Means are provided for resiliently biasing the magazine assembly 16 into an operative position, generally indicated at 22, and for allowing the magazine assembly 16 to be moved through a first range of resilient movement. Means mounted for manual movement, generally indicated at 24, are provided for (1) allowing the magazine assembly 16 to be resiliently biased into an operative position with the nosepiece portion 14 and be movable therefrom in response to an unwanted fastener deformation so as to allow the deformed fastener to self clear after which the magazine assembly 16 is returned to the operative position and (2) allowing manual movement of the magazine assembly 16 rearwardly from the nosepiece portion 14 so as to enable an operator to gain access to the drive track 18 if the deformed fastener does not self clear by virtue of the resilient movement. The nosepiece portion 14 extends vertically downwardly from the housing 12 and forwardly thereof and is mounted rigidly thereto by any suitable means as, for example, bolts or the like (shown in FIG. 1).

Figure 2:
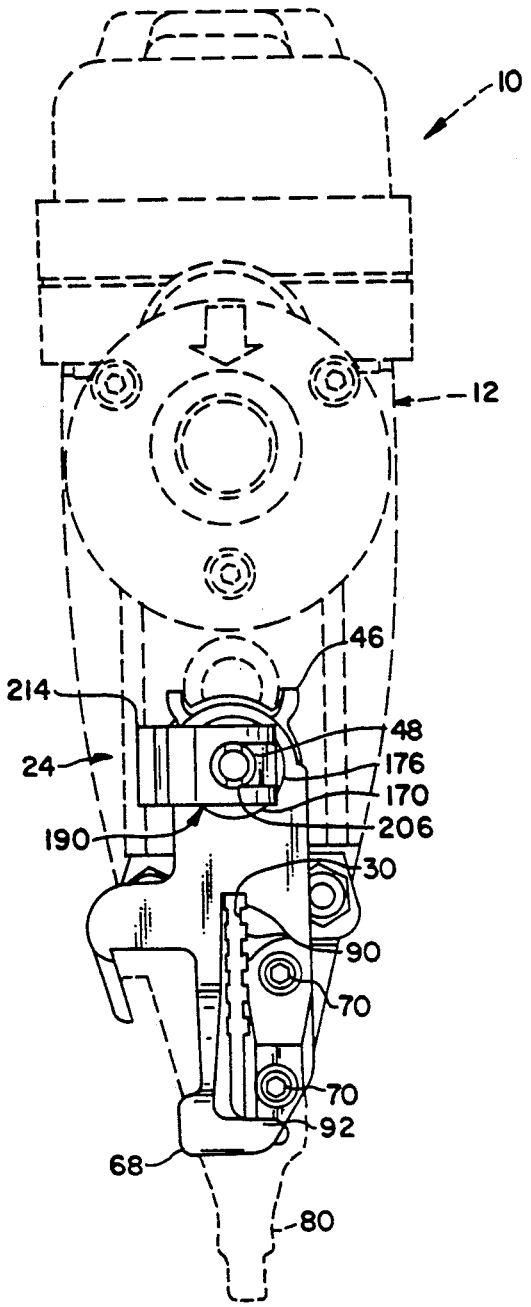
FIG. 2 is a rear elevational view of the device with the housing structure shown in dotted lines.

The magazine assembly 16 of the present invention is useful in handling and feeding fasteners of various heights supplied in the form of rigid strips with their shanks in abutting relation as best shown in FIG. 2. These fasteners are typically supplied in abutting relation and may be of the T-nail or D-nail type, brads, or other headless types of nails or the like.

Means for mounting the magazine assembly with respect to the housing 12 is provided which includes a pair of horizontally opposed guide pins 40 threadedly engaged with nosepiece portion 14 and a pair of cooperating holes 42 in the magazine assembly 16 which permit sliding movement of the magazine assembly relative to the nosepiece portion 14 and a latch pin 44 threadedly engaged with the housing 12 and extending through a mounting block 46. Mounting rod 48 extends into mounting block 46 and magazine assembly 16 so as to slidably secure the magazine assembly 16 to housing 12.

Figure 3:
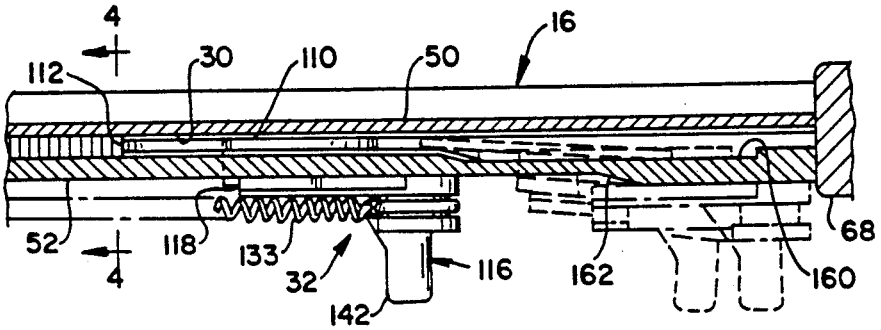
FIG. 3 is a fragmentary sectional view taken along line 3—3 of FIG. 1 shown with the pusher member shown in solid lines in an operative position and in dotted lines showing the manual movement to a rear latched position.

As shown in FIGS. 1 and 3, the magazine assembly 16 includes a fastener stick receiving feed track 30 of a size to receive therein a fastener stick made of the fasteners described above. Means for biasing a stick of fasteners, generally indicated at 32, is provided to resiliently urge the leading fastener of the stick within the magazine assembly 16 toward drive track 18. The width of drive track 18 when in an operative position, serves to position the leading fastener within the drive track 18 and the next adjacent fastener and the stick wholly without the drive track 18. The leading fastener is thus presented in a position so that its upper striking surface will be engaged by the lower surface of the fastener driving element 20 during its downward drive stroke. The engagement of the fastener-driving element 20 with the striking surface of the leading fastener serves to move it downwardly and hence strip it from the remaining fasteners in the stick.

Figure 4:
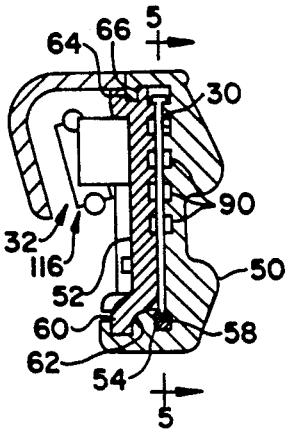
FIG. 4 is a sectional view taken along line 4—4 of FIG. 3 of the magazine assembly.
Figure 5:
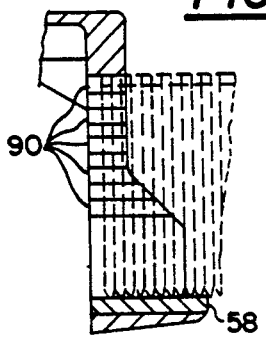
FIG. 5 is a partial fragmentary view taken along line 5—5 of FIG. 4 showing a stick of fasteners.

Referring now more particularly to FIGS. 1, 3 and 4, the magazine assembly 16 includes a magazine core 50 and a second magazine member 52 disposed parallel thereto which define therebetween a fastener feed track as described heretofore. Magazine core 50 is an elongated member having a generally L-shaped cross-sectional configuration. A lower portion of magazine core 50 includes a longitudinal groove 54 for carrying bottom-surface supporting means 58. A second longitudinal groove 60 is formed in the lower portion of magazine core 50 together with arcuate wall section 62 for mating engagement with a lower portion of second magazine member 52 as best shown in FIG. 4. Similarly, magazine core 50 has a longitudinal projection 64 to be brought into engagement with longitudinal groove 66 in second magazine member 52.

A magazine end cap 68 is provided which is disposed in abutting relationship with the magazine core 50 and second magazine member 52 and is provided with a series of bolts 70 or the like which serve not only to retain the magazine end cap 68 in secured relationship to the magazine members but to fix the positions of magazine core 50 and second magazine member 52 relative to each other. A magazine nose portion 80 is secured to the front portion of first and second magazine members with a series of bolts or the like which also serve to fix the positions of the magazine members relative to each other. As discussed previously, cooperating holes 42 in the magazine assembly 16 extend longitudinally through magazine nose portion 80. Magazine nose portion 80 is preferably made of a wear resistant material such as hardened steel to resist wear generated by the sliding movement of the magazine assembly 16 relative to the guide pins 40 carried by the nose portion 14 which is due to repeated movement of the magazine assembly 16 relative to nose portion 14.

Magazine core 50 has a side wall portion that extends the longitudinal length thereof for slidably supporting one side of the shanks of the fastener stick and second magazine member 52 has a side wall portion extending a major portion of its longitudinal length for slidably supporting the opposite side of the fastener stick. The magazine core 50, the second magazine member 52, the magazine end cap 68 and magazine nose portion 80, all have complementary longitudinal grooves 90 formed therein. Magazine end cap also has a feeding surface 92 disposed rearwardly of the feed track onto which the pointed ends of the fasteners are placed when the fasteners are loaded into the magazine assembly so that the fasteners are correctly positioned with longitudinal grooves 90. The fastener adjacent to the leading fastener and the remainder of the fastener stick are thus in a position in the feed track so that their upper striking surfaces will be engaged by the lower surface of the longitudinal groove 90 during the upward stroke of fastener driving element 20. In the preferred embodiment shown, five grooves are placed in vertical stacked relationship in each elongated magazine member, thereby allowing magazine assembly 16 to accommodate five different heights, but it will be appreciated that any number may be used to accomplish the desired height variation. As previously discussed, means for biasing a stick of fasteners 32 are provided for urging the fastener stick toward the drive track 18. Biasing means 32 includes a pusher 110 which has a width somewhat smaller than that of the feed track so as be slidable therein and a vertical front edge portion 112 that is adjacent to the trailing fastener when the magazine assembly 16 is in an operative position. An internally threaded stud member 114 is press-fit into one side of pusher 110 and extends laterally therefrom. A pusher handle assembly, generally shown at 116, is laterally disposed from the feed track on an outside wall of second magazine member 52. Pusher handle assembly 116 contains a studlike portion 118 which extends through elongated slot 120 for guiding the pusher handle assembly 116 when longitudinally moved within the slot 120. Pusher handle assembly 116 has two smaller studlike members (not shown) for engaging the openings in pusher 110. Studlike portion 118 performs the additional function of properly spacing pusher handle assembly 116 from pusher 110 on either side of second magazine member 52. Screw 122 is threadedly engaged with stud portion 114 so as to secure pusher handle assembly 116 to pusher 110. Elongated slot 120 extends substantially the entire length of second magazine member 52 as best shown in FIG. 1. An exterior cover 130 is provided which is secured to second magazine member 52 by screws 132. A tension spring 133 is provided having one end anchored to a tab 134 located between cover 130 and second magazine member 52 and located near the rear end thereof. The spring 133 extends forwardly around a pulley 136 journaled on a horizontal shaft 138 mounted on the forward end of second magazine member 52 and then extends rearwardly having its other end anchored to a roll pin 140 press fit into a rear portion of handle 116. Pusher handle assembly 116 also includes a handle portion 142 extending laterally from second magazine member 52 and below cover 130 so that the handle portion 142 may be manually grasped to be moved rearwardly. Cover 130 serves to protect and conceal spring 133. Thus, tension spring 133 serves to resiliently urge pusher 110 forwardly towards drive track 18.

Second magazine member 52 also includes a arcuate slot 150 disposed rearwardly of slot 120 and communicating therewith. Disposed below slot 120 and between arcuate slot 150 is an abutment 152. Second magazine member 52 also includes an interior recess 160 in the rear portion thereof as best shown in FIG. 3 and an exterior cam section 162. Handle assembly 116 when manually moved from the operative feeding position rearwardly engages cam section 162 thereby forcing handle assembly 116 to move laterally. The pusher 110 is then moved laterally out of the feed track and into recess 160 and when handle portion 142 is tilted front edge portion 112 engages abutment 152 thereby positioning handle assembly 116 into a rearward locked position enabling an operator to load a stick of fasteners into an operative position in the feed track.

The means for resiliently biasing the magazine assembly 22 is mounted within magazine end cap 68 and includes a bushing, generally indicated at 170, having a smaller diameter portion 174 slidably mounted within a bore 172 within end cap 68. Bushing 170 has a shoulder portion 176 attached to one side of portion 174 that is longitudinally spaced from bore 172. Smaller diameter portion 174 also has an annular groove 178 that extends longitudinally and terminates in radiused shoulders at both ends. Resilient means 22 also includes a locking pin 180 press fit into magazine end cap 68 and located transverse to the annular groove 178 and engaged therewith. A compression spring 182 is disposed between an end surface of bushing 170 and an end surface of the bore 172 so as to be in engagement with both surfaces and is slightly compressed when bushing 170 is in its furthermost rearward position relative to compression spring 182.

Figure 6:
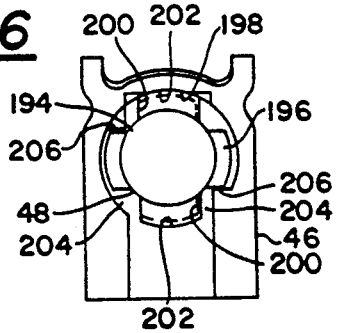
FIG. 6 is a vertical elevational view taken along line 6—6 of FIG. 1 showing the mounting rod in an operative position in solid lines and in dotted lines after the toggle handle has been rotated 90° into the released position.

The means for manual movement 24 includes a latch assembly, generally indicated at 190. The latch assembly 190 includes the previously described mounting rod 48, a toggle handle 192 and a keyway structure located within previously described mounting block 46. The mounting rod 48 has a cylindrical head portion 194 on one end thereof and a keyed portion 196 adjacent thereto. As best shown in FIG. 6, within mounting block 46 is a vertically oriented keyway slot 198 which is formed by sidewall sections 200 and opposed arcuate sections 202. Mounting rod 48 is disposed horizontally within the keyway slot 198 for sliding movement therein. The width of keyway slot 198 is slightly greater than the width of keyed portion 196 of the mounting rod and the diameter of cylindrical head portion 194 is greater than the width of keyway slot 198 so that when keyed portion 196 is horizontally disposed keyed portion 196 is in locking engagement with an outer wall surface 204 of mounting block 46. Mounting block 46 includes a pair of diametrically opposed dogs 206 extending rearwardly from outer wall surface 204 which prevent the clockwise rotation of mounting rod 48 as shown in FIG. 6. Mounting rod 48 can be rotated counterclockwise to align keyed portion 196 with keyway slot 198 so that mounting rod 48 can be moved rearwardly within mounting block 48 until head portion 194 engages outer wall surface 204 thereby limiting the rearward movement.

Toggle handle 192 has a pivot hole 216 through which roll pin 218 is pressed for pivotally mounting toggle handle to mounting rod 48. Toggle handle has a first surface 210 located at a fixed radial distance from pivot hole 216 and a second surface 212 located at a greater radial distance from pivot hole 216 with a camming surface therebetween for over center toggle movement of the latching assembly 190 when toggle handle 192 is rotated. Toggle handle 190 includes a handle portion 214 laterally extending therefrom to be manually grasped for rotational movement.

It will be noted that toggle handle 192 is in cooperative relationship to bushing 170 and compression spring 182 so as to resiliently bias the magazine assembly 16 into an operative position adjacent to nosepiece portion 14 as shown in FIG. 1. In this operative position, first surface 210 of toggle handle 192 is brought into abutting engagement with shoulder 176 of bushing 170 resulting in sliding movement of bushing 170 within bore 172 thereby further compressing compression spring 182 into mounting block 46 which serves to bias magazine assembly 16 into an operative position. As shown, in this position locking pin 180 is located forwardly in annular groove 178 allowing rearward movement of magazine assembly 16 in response to an unwanted fastener deformation as shown in FIG. 8. This first range of movement is limited when locking pin 180 abuts the rear shoulder of annular groove 178 thereby stopping the rearward movement of magazine assembly 16 as shown in FIG. 7. This resilient movement allows the vast majority of deformed fasteners to self clear without the necessity of having to disassemble the device to clear the deformed fastener or otherwise have to move the magazine assembly rearwardly as discussed below. The resilient bias also serves to return the magazine assembly to the operative position following the self clearing of the fastener deformation or jam.

In the event that the fastener fails to self clear by virtue of the resilient movement, then it will be understood that the latch assembly has a release position wherein the magazine assembly 16 is freely movable throughout a second range of movement beyond the first range of resilient movement enabling a deformed fastener to be cleared from drive track 18. This second range of movement consists of a third range and fourth range of movement within the second range of movement. Before the latch assembly is moved into the released position, it is desirable to first move the pusher handle assembly 116 into its rear locked position so that the fastener stick will not be biased into the drivetrack. It should be noted, however, in the event that the operator fails to do so the limited movement allowed within the third range of movement will prevent a discharge of fasteners from the device. In the third range of movement the magazine assembly 16 is moved into the released position by manually rotating toggle handle 192 so that second surface 212 of toggle handle 192 is vertically oriented. By moving toggle handle 192 into the released position a gap is created between second surface 212 and shoulder 176 allowing magazine assembly to be manually moved rearwardly allowing access to drive track 18 as shown in FIG. 10. It should also be noted that compression spring 182 no longer is biasing magazine assembly 16 into nosepiece portion 14 when the magazine assembly is in the released position. This third range of free movement is limited when shoulder 176 is brought into abutting relation with second surface 212 as shown in FIG. 9.

A fourth range of free movement within the second range of movement is available beyond the third range of movement by rotating toggle handle clockwise as viewed in FIG. 2 and manually moving toggle handle 192 rearwardly. When the toggle handle 192 is rotated keyed portion 196 is brought into alignment with keyway slot 196 allowing further rearward movement of mounting rod 48. By moving toggle handle 192 rearwardly a gap is created between second surface 212 and shoulder 176 allowing magazine assembly 16 to be manually moved rearwardly allowing access to drive track 18 as shown in FIG. 12. It should be noted that the length of guide pins 40 are greater than the furthermost movement permitted by the latch assembly so that magazine assembly 16 is kept in sliding engagement with the guide pins 40 as shown in FIG. 14. This fourth range of free movement is limited when shoulder 176 is brought into abutting relation with second surface 212 as shown in FIG. 11. It will be appreciated that the latch assembly 190 as described permits quick release of the magazine assembly from the operative position to the released position allowing an operator to quickly and easily remove a deformed fastener from the drive track 18. Likewise, the magazine assembly 16 can be quickly and conveniently returned to the operative position by reversing the steps heretofore described.

It will thus be seen that the objects of the invention have been fully and effectively accomplished. It will be realized, however, that the foregoing preferred specific embodiment has been shown and described for the purpose of illustrating the functional and structural principles of the invention and is subject to change without departure from such principles. Therefore, this invention includes all modifications encompassed within the spirit and scope of the following claims.

What is claimed is:

1. A device for driving successive fasteners from a stick of fasteners, said device comprising:

a housing structure including a handle portion defining a manually engageable handle for enabling a user to portably operate said device and a nosepiece portion disposed forwardly thereof, a magazine assembly extending rearwardly from said nosepiece portion and defining therewith a drivetrack, a fastener driving element slidably mounted in said drivetrack, power operated means for moving said fastener driving element within said drivetrack through successive operative cycles each including a drive stroke in one direction and a return stroke in an opposite direction, said magazine assembly including structure defining a fastener stick receiving feedtrack and means for biasing a stick of fasteners in said feedtrack so as to move a leading fastener of said stick into said drivetrack to be driven therefrom during the drive stroke of said fastener driving element into a workpiece, means for mounting said magazine assembly with respect to said housing structure in an operative position with respect to said nosepiece portion and for movement away from and toward said operative position, means for resiliently biasing said magazine assembly into said operative position and for allowing said magazine assembly to be moved through a first range of movement including resilient movement of said magazine assembly away from said nosepiece portion during an unwanted fastener deformation so as to allow the deformed fastener to self clear after which said magazine assembly is returned to said operative position, and a manual actuator mounted for manual movement between (1) a normal operating position wherein said resilient movement within said first range takes place and (2) a release position wherein said magazine assembly is enabled to be moved through a second range of movement beyond said first range so as to clear a deformed fastener which does not self clear by virtue of said resilient movement within said first range.

2. A device for driving successive fasteners as defined in claim 1, wherein travel of the magazine during said first range of movement is limited by a stop member.

3. A device for driving successive fasteners as defined in claim 2, wherein said manual actuator includes a releasable latch assembly mounted for manual movement which permits a third range and a fourth range of movement of said magazine assembly within said second range wherein said fourth range is beyond said third range when said latch assembly is in said released position.

4. A device for driving successive fasteners as defined in claim 3, wherein said latch assembly includes a mounting block having an internal keyway structure, a movable mounting rod mounted for rotational and sliding movement relative to said internal keyway, and a toggle handle, said mounting block providing a wall adjacent to said internal keyway, said mounting rod having a keyed locking portion adjacent to said wall and a toggle end opposite said head portion, said keyed portion being engageable with said wall when transverse to said keyway and being slidable within said keyway when aligned therewith such that said magazine assembly is movable through said third range of movement when said keyed portion is transverse to said keyway and said magazine assembly is movable through said fourth range of movement when said keyed portion is aligned with said keyway.

5. A device for driving successive fasteners as defined in claim 4, wherein said mounting means includes a pair of identical guide pins fixed to said nosepiece portion, a pair of cooperating holes in said magazine assembly permitting sliding movement of said magazine assembly relative to said nosepiece portion, and a pivot pin slidably connecting said magazine assembly to said housing structure.

6. A device for driving successive fasteners as defined in claim 5, wherein the guide pins have a length such that longitudinal engagement of said guide pins with said magazine assembly is greater than the longitudinal distance that said magazine assembly is moved when at the end of said fourth range of movement.

7. A device for driving successive fasteners as defined in claim 5, wherein said toggle handle has a first surface, a second surface and a pivot hole, said first surface disposed further from said pivot hole than said second surface such that when said first surface is transverse to said feedtrack said latch assembly is in said normal operating position and when said second surface is transverse to said feedtrack said latch assembly is in said release position.

8. A device for driving successive fasteners as defined in claim 7, wherein said biasing means is disposed between said latch assembly and said magazine assembly for biasing said magazine assembly towards said nosepiece assembly when said latch assembly is in said normal position.

9. A device for driving successive fasteners as defined in claim 8, wherein said biasing means includes a bushing and a locking pin, said bushing slidably located within said magazine assembly and having an annular groove that extends longitudinally, said locking pin being attached to said magazine assembly and located transverse to said annular groove and engaged therewith, and a spring operatively engaged between said magazine assembly and said bushing, said bushing having one end adjacent to said spring and an opposite end adjacent to said toggle handle.

10. A device for driving successive fasteners as defined in claim 9, wherein said toggle handle is provided with a cam surface located between said first surface and said second surface for engageably urging said bushing into said spring in response to the manual movement of said toggle handle from said released position into said normal position.

11. A device for driving successive fasteners as defined in claim 10, wherein said annular groove has a rear shoulder such that rearward movement of said bushing in response to forces generated by a fastener deformation when said toggle handle is in said normal position is limited by engagement of said locking pin with said rear shoulder.

12. A device for driving successive fasteners as defined in claim 1 in combination with a fastener stick, each fastener of the fastener stick having a shank portion and a head portion attached thereto, said head portions laterally extending from said shank portions enabling said shanked fasteners to be detachably secured together in a longitudinal formation consisting of a leading fastener, a trailing fastener and a row of fasteners therebetween, each fastener of the formation having a shank portion disposed in generally abutting relation to the shank portions of the fasteners adjacent thereto, said fasteners each including respective point portions located opposite said head portions.

13. A device for driving successive fasteners as defined in claim 12 wherein said magazine assembly comprises an elongated magazine core and a second magazine member in mating engagement therewith, a magazine nose portion in mating and fixed relation with said magazine core and said second magazine member, and a magazine and cap in mating and fixed relation with said magazine core and said second magazine member, said magazine core including bottom-supporting surface means disposed in a generally horizontal plane for slidably receiving the pints of fasteners in said feed track, said magazine core and said second magazine member and said magazine nose portion and said magazine end cap having structure cooperating to define the feed-track, said magazine core having a side wall portion for supporting one side of the shanks of said fasteners, said second magazine member having a side wall portion for slidably supporting an opposite side of said fasteners in said feed track, each of said magazine core and said second magazine member and said magazine nose portion and said magazine end cap having respective longitudinal grooves formed therein said grooves communicating with each other for engaging the uppermost surface of said head portions during the return stroke of said fastener driving element, the grooves defining surfaces so as to prevent the upward movement of said fasteners and to enable said magazine assembly to accommodate fasteners of varying lengths.

14. A device for driving successive fasteners as defined in claim 13 wherein said means for biasing a stick of fasteners includes a pusher member slidably mounted in said fastener feed track and spring means disposed for resiliently urging said pusher member forward.

15. A device for driving successive fasteners as defined in claim 14 including self-locking and manually releasable latching means carried by a rear end portion of said second magazine member for maintaining said pusher member in a rearward loading position laterally disposed from said feed track against the action of said spring means enabling an operator to load a stick of fasteners into an operative position in said feed track.

16. A device for driving successive fasteners as defined in claim 15 wherein said second magazine member includes a recessed portion laterally spaced from said feed track and communicating therewith and camming means for said pusher assembly for effecting lateral movement of said pusher assembly from an operative position within said feed track to said rearward loading position laterally spaced from said feed track.

* * * * *